US006354768B1

(12) United States Patent
Fox

(10) Patent No.: US 6,354,768 B1
(45) Date of Patent: Mar. 12, 2002

(54) SOIL REINFORCEMENT METHOD AND APPARATUS

(75) Inventor: Nathaniel S. Fox, Scottsdale, AZ (US)

(73) Assignee: Geotechnical Reinforcement Company, Inc., Scottsdale, AZ (US)

( * ) Notice: Subject to any disclaimer, the term of this patent is extended or adjusted under 35 U.S.C. 154(b) by 0 days.

(21) Appl. No.: 09/490,670

(22) Filed: Jan. 24, 2000

(51) Int. Cl.[7] ..... E02D 5/44
(52) U.S. Cl. ..... 405/238; 405/287.1
(58) Field of Search ..... 405/130, 229, 405/231, 232, 238, 287.1

(56) References Cited

U.S. PATENT DOCUMENTS 4,334,345 A * 6/1982 Jenks
5,202,522 A * 4/1993 Williams
5,249,892 A * 10/1993 Fox et al.

* cited by examiner

*Primary Examiner*—Roger Schoeppel
(74) *Attorney, Agent, or Firm*—Banner & Witcoff, Ltd.

(57) ABSTRACT

A method and apparatus for improving the stiffness of soil by forming an opening in the ground, inserting an expandable member, and distending the expandable member.

15 Claims, 4 Drawing Sheets

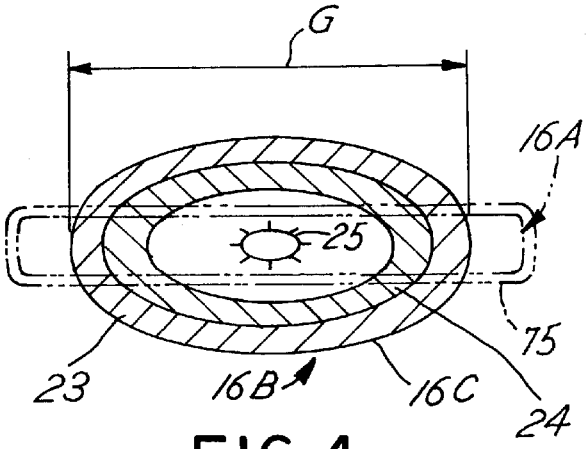
FIG. 4
FIG. 5
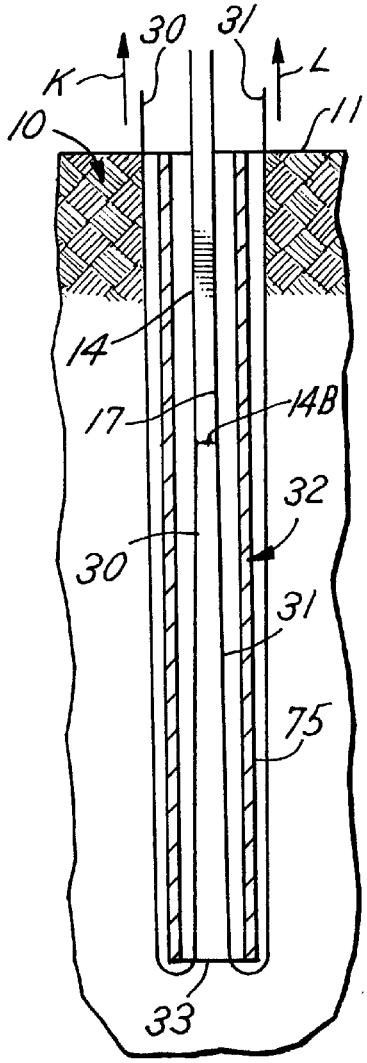

SOIL REINFORCEMENT METHOD AND APPARATUS

BACKGROUND OF THE INVENTION

1. Field of the Invention

This invention relates to a method and apparatus for reinforcing soil by improving the stiffness of soil.

In a further respect, the invention relates to a method and apparatus for constructing a structure at a selected building site.

In another respect, the invention relates to a method and apparatus for inexpensively improving the stiffness of soil supporting freeway embankments, water tanks, and other large loads which occupy large areas of ground, especially in situations where the soil supporting the large load is soft and is compressible by relatively light loads.

In still a further respect, the invention relates to a method and apparatus for supporting smaller structures, including buildings, storage silos, etc. which generate a smaller load on soil and occupy smaller areas of ground.

2. Description of the Related Art

My U.S. Pat. No. 5,249,892 describes aggregate piers which are constructed to improve the stiffness of soil. Each aggregate pier is constructed by forming a cavity in the ground and by then compacting layers of aggregate in the cavity to form a substantially stiff, dense aggregate pier. Each aggregate pier is typically ten to forty-five times stiffer than soil. The aggregate pier and soil surrounding the pier comprise a cell which has a composite stiffness about five to fifteen times greater than the stiffness of the soil without the pier. Although the aggregate pier is effective in increasing the stiffness of soil, the pier has disadvantages. In particular, it is not practical to install an aggregate pier which extends to great depths. If it is therefore desirable to improve the stiffness of soil at depths of greater than about twenty feet, an aggregate pier is not practical. In addition, in some cases it is not necessary to stiffen soil to the degree provided by an aggregate pier.

Accordingly, it would be highly desirable to provide an improved method and apparatus for increasing the stiffness of soil at depth of up to one hundred and fifty feet and at a cost which is significantly less than the cost of utilizing aggregate piers.

SUMMARY OF THE INVENTION

Therefore, it is a principal object of the invention to provide an improved method and apparatus for stiffening soil.

A further object of the instant invention is to provide an improved method and apparatus for stiffening soil at depths of up to one hundred and fifty feet.

Another object of the invention is to provide an improved method and apparatus which can be utilized to stiffen soil at a cost which is significantly less than that encountered in using aggregate piers or other soil reinforcing systems.

These and other further and more specific objects and advantages of the invention will be apparent to those skilled in the art from the following detailed description thereof, take in conjunction with the drawings, in which:

BRIEF DESCRIPTION OF THE DRAWING

FIG. 4 is a cross-section view of a portion of the apparatus of FIG. 2 illustrating further construction details thereof;

FIG. 5 is a side elevation view illustrating one procedure for installing in the ground at a building site the apparatus illustrated in FIGS. 1 and 2;

DESCRIPTION OF THE PREFERRED EMBODIMENTS

Figure 1:
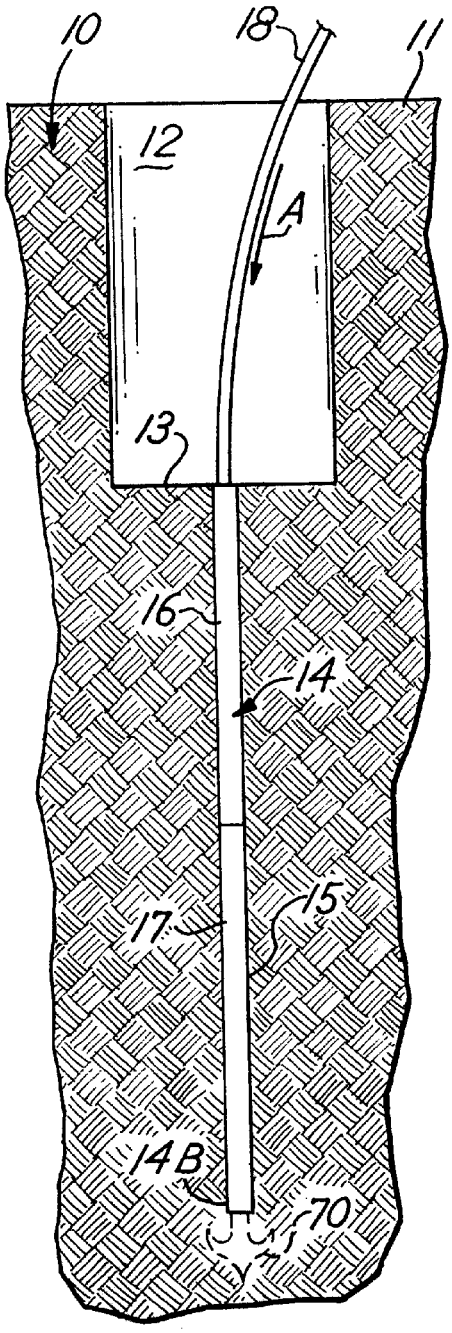
FIG. 1 is a side elevation view illustrating apparatus being installed in the ground at a building site to improve the stiffness of soil comprising the ground.

Briefly, in accordance with my invention, I provide an improved building site. The building site includes a section of ground including existing soil having an in situ density and in situ stress state, and includes a structure constructed on the section of ground. The improvements increase the stiffness of the soil and comprise a soil stiffening system. The soil stiffening system includes a cavity beneath the structure in the section of ground; and, at least one elongate expandable member in the cavity. The expandable member has a normal configuration, and an expanded configuration in which the member is distended. The soil stiffening system also includes a composition in the expandable member. The composition expands the expandable member from the normal configuration to the expanded configuration. The soil stiffening system further includes densified, stressed, strained soil adjacent the expandable member. The densified soil consists of at least one portion of the existing soil densified, stressed, and strained when the expandable member is expanded from the normal configuration to the expanded configuration.

In another embodiment of the invention, I provide an improved method for building a structure at a building site including a section of ground including existing soil having an in situ density and an in situ stress state. The method includes the steps of forming a cavity in the section of ground; and, providing at least one elongate expandable member. The expandable member has a normal configuration, and has an expanded configuration in which the member is distended from the normal configuration. The method also includes the steps of inserting the expandable member in the cavity in the normal configuration; of at least partially filling the expandable member with a composition to expand the expandable member to the expanded configuration, and to densify, strain, and stress portions of the soil adjacent the expandable member; and, of constructing the structure at the building site above the cavity and the expandable member in the cavity.

In a further embodiment of the invention, I provide an improved method for building a structure at a building site. The building site includes a section of ground including existing soil having an in situ density and an in situ stress state. The improved method includes the steps of forming a cavity in the section of ground; and, providing at least one elongate expandable member. The expandable member has a normal configuration, and has an expanded configuration in which the member is distended from the normal configuration. The method also includes the steps of inserting the expandable member in the ground beneath the cavity in the normal configuration; of at least partially filling the expandable member with a composition to expand said expandable member to said expanded configuration, and to densify, stress, and strain portions of the soil adjacent the expandable member; inserting aggregate in the cavity; of compacting the aggregate; and, of constructing the structure at the building site above the cavity and the expandable member in the cavity.

Turning now to the drawings, which depict the presently preferred embodiments of the invention for purpose of illustrating the invention and not by way of limitation of the scope of the invention, and in which like reference characters refer to corresponding elements throughout the several views, FIG. 1 illustrates a soil stiffening system being constructed in accordance with the principles of the invention in a section of ground including soil 10 having an in situ density and an in situ stress state. The in situ density of the soil comprises the density prior to a building or other structure being constructed on the soil and prior to the insertion in the soil of aggregate piers or other structure to increase the stiffness of the soil. The in situ stress state includes the horizontal stress of the soil prior to a building or other structure being constructed on the soil and prior to the insertion in the soil of aggregate piers or other structures to increase the stiffness of the soil. The section of ground includes an upper surface 11. During construction of the soil stiffening system, a cylindrical cavity 12 is formed in the ground. The shape and dimension of cavity 12 can vary as desired. The soil at the bottom 13 of the cavity is compacted to densify the soil at the bottom of the cavity. An elongate expandable member 14 is inserted in the ground in elongate cavity 15. Cavity 15 extends downwardly from the bottom 13 of cavity 12. Member 14 includes an upper section 16 and a lower section 17. If desired, cavity 12 need not be formed in the ground, and member 14 (and cavity 15) can simply extend downwardly from surface 11. In addition, member 14 can extend downwardly from beneath a loaded member such as a footing, mat, or slab.

Figure 2:
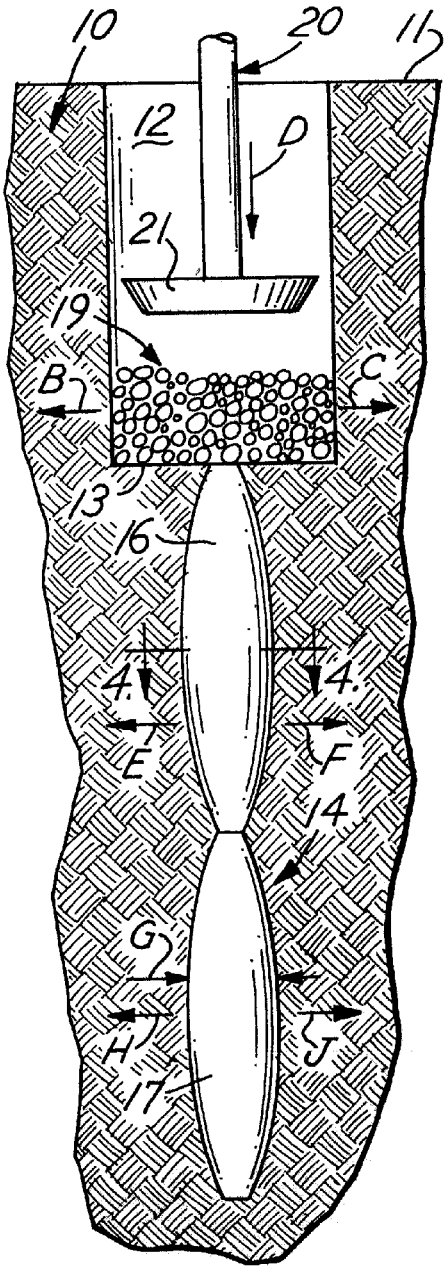
FIG. 2 is a side elevation view of the apparatus of FIG. 1 illustrating further steps taken to install the apparatus in the ground at a building site.

After member 14 is positioned in the ground in the position shown in FIG. 1, a hose 18 is used to direct, in the direction of arrow A, air, slurry, sand, foam, or another gas, liquid, or solid substance or composition or combination thereof into member 14 to expand member 14 into a desired shape and dimension. FIG. 2 illustrates segments 16 and 17 after they have expanded into, by way of example, ellipsoid shapes. Segments 16 and 17 can, as noted, expand into any desired shape and dimension. When expandable segments 16 and 17 expand in the directions indicated by arrows E, F, H, and J, they displace, stress, strain, and densify soil which is adjacent segments 16 and 17.

After segments 16 and 17 are expanded as desired, the lower portion of cavity 12 is filled with a quantity of loose, well-graded aggregate 19. Other granular material besides loose, well-graded aggregate can be utilized. Well-graded aggregate is presently preferred because the larger particles in the aggregate impart substantial strength. The smaller particles in the aggregate fill the interstitial spaces between the larger particles. The depth or height of the layer of aggregate 19 can vary as desired but is presently in the range of six inches to three feet, preferably about eighteen inches.

The layer of aggregate is compacted with tamping apparatus including beveled head 21 and shaft 20 attached to head 21. Head 21 and shaft 20 are displaced in the direction of arrow D, retracted in a direction oppositive arrow D, displaced in the direction of arrow D, etc. until the aggregate 19 is densified and produces lateral forces acting in the directions indicated by arrows B and C. The amount by which the layer of aggregate 19 is compressed by the tamping apparatus can vary as desired, but presently tamping reduces the height of the aggregate 19 layer by about one-third.

After the layer of aggregate 19 is compacted, an additional layer of loose aggregate is inserted in cavity 12 on top of the compacted layer of aggregate 19. This additional layer is then compacted in a fashion similar to that utilized to compact the layer of aggregate 19, and the process is repeated (i.e., additional layers of loose aggregate are inserted in cavity 12 and are compacted on top of existing previously compacted layers) until cavity 12 is filled.

Once cavity 12 is filled, additional cavities 50 to 54 are formed in the ground. The bottom of each cavity 50 to 54 is compacted (but, if desired, need not be compacted), and elongate expandable members 61, 62, 64, 65, 66 are each inserted into the ground through the bottom of a different one of the cavities 50 to 54 and are inflated or filled to expand into the ellipsoid-type shapes illustrated in FIG. 3. When members 60 and 63 are inserted, a cavity 12 or 50 to 54 is not formed in the ground. Instead, members 60 and 63 are inserted in the ground, extend downwardly from the surface 11, and are expanded to form the ellipsoid-type segments shown in FIG. 3.

If desired, an expandable member 60 can be inserted in the ground such that the top end 60A of member 60 is not positioned at surface 11, but is spaced apart from and at a desired distance beneath surface 11. In this scenario, member 60 is in the same vertical configuration illustrated in FIG. 3, with bottom end 60B positioned beneath and spaced apart from top end 60A. This occurs, for example, in FIG. 3 if member 65 remains in the same position and if both cavity 53 and the aggregate in cavity 53 are not utilized.

The shortest distance Y between each pair of cavities 12, 50 to 54 can vary as desired, but is presently preferably in the range of about one to ten feet. The maximum diameter or width of each cavity 12, 50 to 54 can vary as desired, but is presently preferably in the range of about six inches to forty-eight inches. The shortest distance between each pair of expandable members 14, 60 to 66 can vary as desired, but is presently preferably in the range of about two to ten feet. The maximum width G of each inflated or distended member 14, 60 to 66 or segment 16, 17 thereof can vary as desired, but is presently preferably in the range of about six inches to thirty-six inches.

Figure 3:
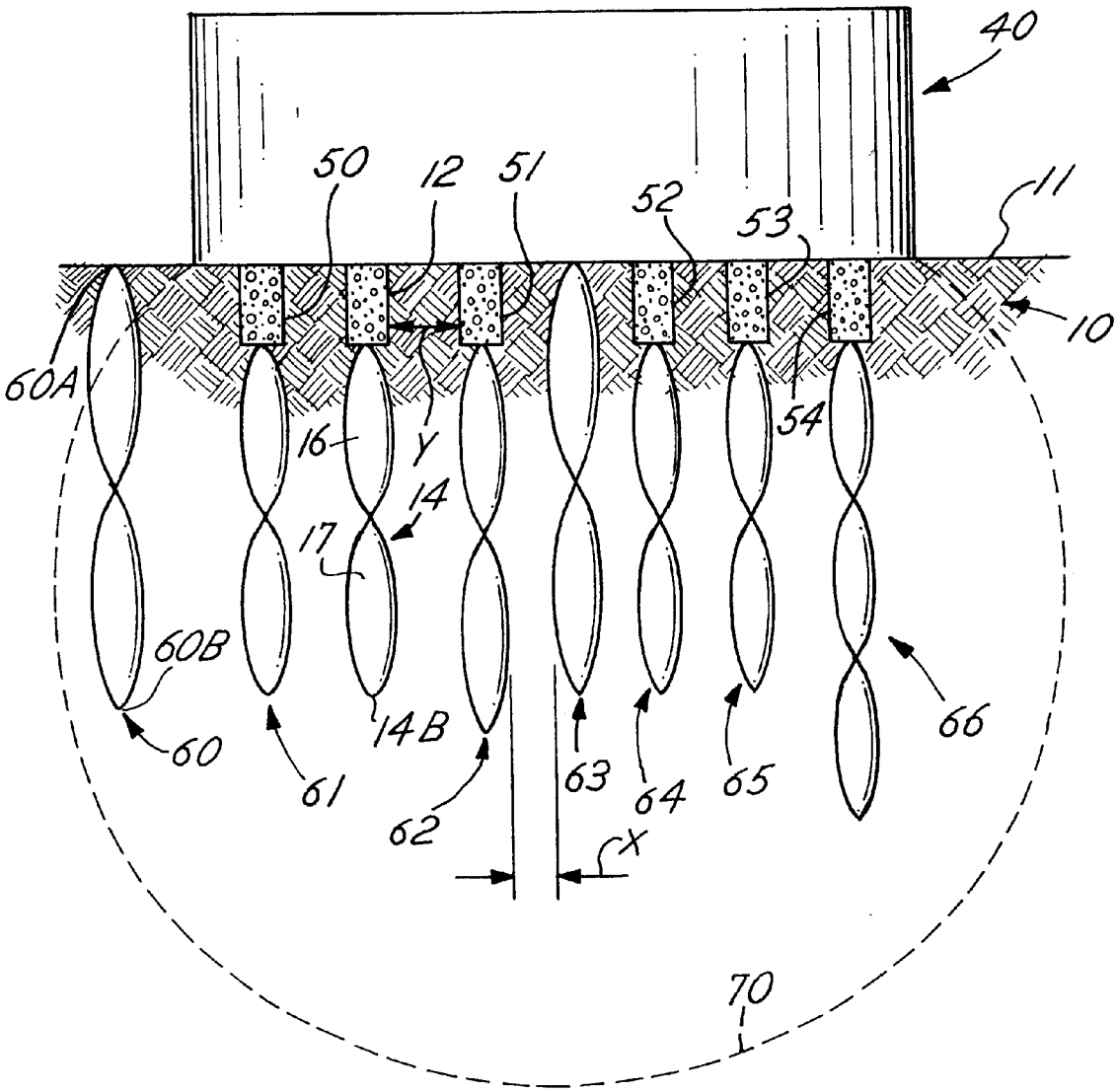
FIG. 3 is a side elevation view illustrating a structure constructed at a building site using apparatus of the type shown in FIGS. 1 and 2.

After cavities 12, 50 to 54 are formed and filled in the manner shown in FIG. 3, and after expandable members 14, 60 to 66 are installed and expanded in the manner shown in FIG. 3, a water or other storage tank 40 or other structure is constructed on the ground. Alternately, as earlier noted above, under some circumstances, expandable members 14, 60 are installed without the need for cavities 12, 50 to 54, and expandable members 14, 60 to 66 are expanded generally in the manner shown in FIG. 3 or in any other desired manner. Tank 40 generates significant or other forces on or in the soil generally beneath tank 40 in an area generally indicated by dashed line 70. As is evidenced by dashed line 70, some of the soil affected by and supporting tank 40 is not immediately beneath tank 40. It is often advantageous to reinforce soil which is not directly beneath tank 40 but which still functions to reinforce and stiffen soil supporting tank 40. Member 60, for example, fulfills such a function.

The construction of an expandable member 14, 60 to 66 can vary as desired. FIG. 4 illustrates in greater detail a presently preferred construction of expandable segment 16 of member 14. In FIG. 4, reference character 16A indicate segment 16 prior to its being inflated. Reference character 16B indicates segment 16 after it is inflated. Segment 16 includes an inner sealing layer 24 formed from a rubber, polypropylene, plastic or other expandable material. Layer 24 prevents the air or other composition which is used to fill and expand segment 16 from passing through layer 24 such that segment 16 deflates or contracts. In the event a concern exists that, for example, air utilized to inflate and expand a segment 16 will over time gradually permeate and escape outwardly through layer 24 and allow segment 16 to deflate, then segment 16 can be filled with sand, grout, foam, slurry or another material which solidifies and hardens. In the event segment does deflate or contract, one alternative is that air or another composition may be re-introduced in segment 16 to expand segment 16 a desired amount.

As illustrated in FIG. 1 and earlier noted, an expandable member 14 can include a plurality of separate segments. Or each segment 16, 17 can comprise a separate member which can be utilized alone and stacked on or besides another segment.

Layer 23 is attached to and circumscribes layer 24. Layer 23 is also expandable, but is porous and permits air, gas, or liquid to permeate layer 23 and travel upwardly to the surface 11 of the ground. Porous layer 23 facilitates the densification of soil because when air, gas, water or another fluid is permitted to escape from the soil, soil particles more readily travel toward one another and reduce the average distance and or space between the particles.

In FIG. 4, aperture 25 interconnects segments 16 and 17 such that when (in FIG. 1) air or another composition is directed in the direction of arrow A through hose 18 into segment 16, the air can readily pass from segment 16 into segment 17. A member 14, 60 to 66 can consist of one or more segments 16, 17.

The installation of an expandable member 14 in soil can be accomplished by any desired method. One procedure for installing an expandable member 14, 60 to 66 in the ground is to drive or push a hollow rectangular conduit or mandrel 32 into the ground to form a rectangular cavity 75 in the soil. When conduit 32 is being driven or pushed into the ground, lines 30 and 31 extend into the conduit 32, through end 33, and up and around the outside of conduit 32. While conduit 32 is driven into the ground, lines 30 and 31 also are fed into the ground such that both ends of a line 30, 31 remain above the ground and such that each line continues to extend into conduit 32, through the bottom 33 of conduit 32, and up along side the outer surface of conduit 32 to the surface 11 of the ground. When conduit 32 has reached its desired depth, one end of each of lines 30 and 31 is tied to the bottom 14B of member 14. Lines 30 and 31 are pulled in the directions indicated by arrows K and L, respectively, to draw the bottom 14B down to the bottom 33 of conduit 32. If desired, an anchor 70 can be attached to the bottom 14B of member 14 to anchor bottom 14B in the ground at the bottom of conduit 32. Conduit 32 is then removed from the ground. Any other means can be utilized to anchor member 14 in the ground. Expanding segments 16 and 17 into the ellipsoid shapes shown in FIG. 2 may function of its own accord to anchor member 14 in the ground such that additional anchoring mechanisms are not required.

In the relevant industry in which the invention is utilized, the terms hard, soft, loose, and dense sometimes refer to soil consistency, sometimes to soil strength, and sometimes to soil stiffness. For the sake of clarity and certainty, the following terms when utilized herein have the meanings set forth when used to describe soil consistency:

| | |
|---|---|
| Hard: | not easily penetrated. |
| Soft: | easily penetrated. |
| Loose: | composed of particles capable of free movement. |
| Dense: | composed of particles which are crowded close together and which, because they are crowded close together, tend to resist free movement. |
| Stress: | the internal forces interacting between particles of soil, caused by the external forces, such as compression or shear, which produce the strain. |
| Strain: | to cause alteration of form, shape, or volume of a selected portion of soil. |

Soil stiffness is the ability of soil to resist being compressed when subjected to a compressive load.

Soil densification is reducing the average space between particles making up soil.

Based on the foregoing, it is, for example, possible to have a soft soil like a rich, dry, loamy "peat moss". It is also possible to have a soft soil comprised of small, interlocking volcanic particles. The particles are close together, but the soil is readily penetrated because the particles are each porous and are filled with air or water cavities. However, because the volcanic particles interlock, the volcanic particles may (unless the compressive force are sufficient to cause the volcanic particles to break) not readily compress and the soil may have significant stiffness and provide significant resistance to densification.

One application of anchor members 14, 60 to 66 is for reinforcing subsoils at depths greater than the depths to which the aggregate piers extend. Members 14, 60 to 66 presently extend to depths of two hundred feet, preferably to about one-hundred and fifty feet. If, for example, the aggregate pier comprised of cavity 12 and the tamped aggregate in cavity 12 extends from surface 11 to a depth of twenty feet, then member 14 can extend from a depth of twenty feet to a depth of one hundred feet such that end 14B is one hundred feet beneath surface 11.

The distance, indicated by arrows X in FIG. 3, between each adjacent pair 62–63 of expandable elastic members is in the range of two to ten feet, preferably about three to six feet. In loose sandy soil, utilizing elastic members 14, 60 to 66 which are spaced apart about five feet enables the soil to support from 1000 to 7000 psf. If expandable members 14, 60 to 66 are spaced apart three feet (instead of five feet), then the soil may support from 1,500 to about 10,000 psf.

In soft clay soil, utilizing expandable members 14, 60 to 66 which are spaced apart about three feet will enable the soil to support from about 1,000 psf to 5,000 psf. When members 14, 60 to 66 are spaced five feet apart, the soft clay soil will support from about 500 to 2,500 psf.

Members 14, 60 to 66 can be formed in the ground beneath cylindrical tank 40 in a pattern generally similar to the pattern of holes which are formed in a calender in order to permit water to drain from the calendar. While the pattern of members 14, 60 to 66 can vary as desired, it is presently preferred that each adjacent pair of members 14, 60 to 66 be about one to ten feet apart.

The greatest inflated or distended width, indicated by arrows G, of a member 14, 60 to 66 is presently in the range of about one-half to three feet, preferably about two feet. The soil which is densified by a member 14, 60 to 66 extends from the outer surface of a segment 16, 17 out to about fifteen to twenty inches from the outer surface of each segment 16, 17.

One advantage of members 14, 60 to 66 is that the cost per foot of building and installing a member 14, 60 to 66 is only about 15% to 30% of the cost per foot of building an aggregate pier. Another advantage is that members 14, 60 to 66 can each readily extend to great depths of seventy-five feet or greater.

Each inflated member 14, 60 to 66 preferably has a stiffness which can vary as desired but which presently is in the range of about five to twenty times greater than the stiffness of the soil in which member 14, 60 to 66 is utilized. A cell includes the inflated member 14, 60 to 66 in soil and includes the soil which is adjacent the inflated member and extends outwardly from member 14, 60 to 66 a distance equal to the distance from the outer surface of member 14, 60 to 66 (for example, member 62 in FIG. 3) to about half-way between a member 14, 60 to 66 and the closest adjacent member 14, 60 to 66 (for example, member 63 in FIG. 3). The cell has a stiffness which typically, but not necessarily, is two to ten times the stiffness of the soil in which member 14, 60 to 66 is utilized.

Utilization of members 14, 60 to 66 in accordance with the invention produces a greater proportional increase in soil stiffness when members 14, 60 to 66 are utilized in soft clays, soft silts, and loose sands. The invention can, however, be utilized to stiffen clays, silts, and sands which are harder and denser than said soft clays, soft silts, and loose sands; can also be utilized to stiffen peat and organic soils and landfills; and, can be used to generate stresses and strains in almost all types and classifications of soils.

When the stiffness of a soil need only be increased by two to five times, members 14, 60 to 66 can often be utilized without aggregate piers or other soil reinforcement or modification systems or components. Examples of circumstances where a system of members 14, 60 to 66 can be utilized alone are (1) the existing soil is not very compressible, (2) the load which must be supported by the soil is limited, and (3) the allowed settlement of the structure on the existing soil (i.e., the distance a building or load compresses or displaces soil and "sinks" after a building or other load is placed on the soil) is greater than normal. An example of the latter is a highway embankment. The settlement allowed for a highway embankment can be six to twelve inches. An example of a light load is the load generated by a large 200 foot diameter water tank which is forty feet high. The water tank will generate a load of about 2500 psf.

In FIG. 3, the depth of the upper zone of soil equal the depth to which each cavity 12, 50 to 54 is drilled (say, for example, twenty feet) plus the diameter of each cavity (say two feet). Consequently, the depth of the upper zone is twenty-two feet. The lower zone comprises the soil below the upper zone and has a depth which extends downwardly from the upper zone to the bottom of the lower zone. The soil in the upper and lower zones performs in large part the function of supporting tank 40. By way of example, and not limitation, the greatest depth of the lower zone typically is about equal to twice the diameter of tank 40.

In FIG. 3, members 14, 60 to 66 are particularly useful in stiffening soil in the lower zone. This is especially the case because it is not presently economically practical to build aggregate piers which extend to a depth beyond about twenty feet.

As noted earlier, in FIG. 4 dashed lines 16A indicate member 16 prior to its being expanded. Prior to its being expanded, the member 16 illustrated by way of example, and not limitation, in the drawings has the generally rectangular cross-sectional area shown in FIG. 4. Reference character 16B indicates member 16 after it has been inflated or otherwise expanded into an arcuate shape having the elliptical cross section illustrated in FIG. 4. Reference character 16C indicates the outer arcuate surface of member 16 after it has been expanded 16B. The elliptical cross-sectional area of member 16 after it is expanded 16B is presently 1.5 to 6.0 times greater, preferably about 2.0 to 5.0 times greater, than the rectangular cross-sectional area 16A of member 16 prior to the expansion of member 16. In addition, it is preferred that the cavity 75 which is formed in soil to receive member 16 conforms with as little deviation as practically possible to the outer shape and dimension of member 16 prior to member 16 being inflated or otherwise expanded. This is desirable because it means that member 16 ordinarily will have to densify, stress, and strain a greater volume of soil in order for member 16 to fully expand to its desired shape and dimension 16B. In contrast, if the cavity 75 formed in the ground for member 16 has a greater width than the greatest width G of member 16 when member 16 is fully expanded, then member 16 will densify, stress, or strain little, if any, soil immediately adjacent the cavity formed for member 16. Accordingly, not only does expanding member 16 after it is inserted in soil function to increase the cross sectional area of member 16 by a factor in the range of 1.5 to 6.0 times, such expansion also functions (when the cross-sectional area and shape and dimension of the cavity is similar to that of member 16 prior to expanding 16A member 16) to increase by about 1.5 to 6.0 times the cross-sectional area of the cavity 75 in which member 16 is inserted prior to expanding member 16. Such expansion of member 16 and of the cavity 75 is important for several reasons. First, the expanded member 16 usually will have a greater stiffness than the existing soil. Consequently, the greater the expansion of member 16, the greater the volume in the soil which is stiffened by member 16. Second, the expansion of member 16 also increases the volume of the resulting cell. The resulting cell includes member 16 and soil which is in the immediate vicinity of member 16 and which is densified, stressed, and strained when member 16 is expanded. Third, expanding cavity 75 by expanding member 16 functions to density, stress, and strain soil adjacent member 16.

As used herein, the cross-sectional area of a member 16 is the cross-sectional area at a selected point along the length of member 16. The cross-sectional area of a member 16 typically, but not necessarily, will be determined at a point along member 16 where the cross-sectional area is greatest. This is the case, for example, in FIG. 2 where the cross-section indicated by arrows 4 and illustrated in FIG. 4 is taken at a point along the longitude of member 14 where the cross-sectional area of expanded member 16 is greatest. Similarly, the cross-sectional area of a cavity 75 is the cross-sectional area at a selected point along the length of cavity 75. The cross-sectional area of a cavity 75 typically, but not necessarily, will be determined at a point along member 16 where the cross-sectional area is greatest.

Figure 6:
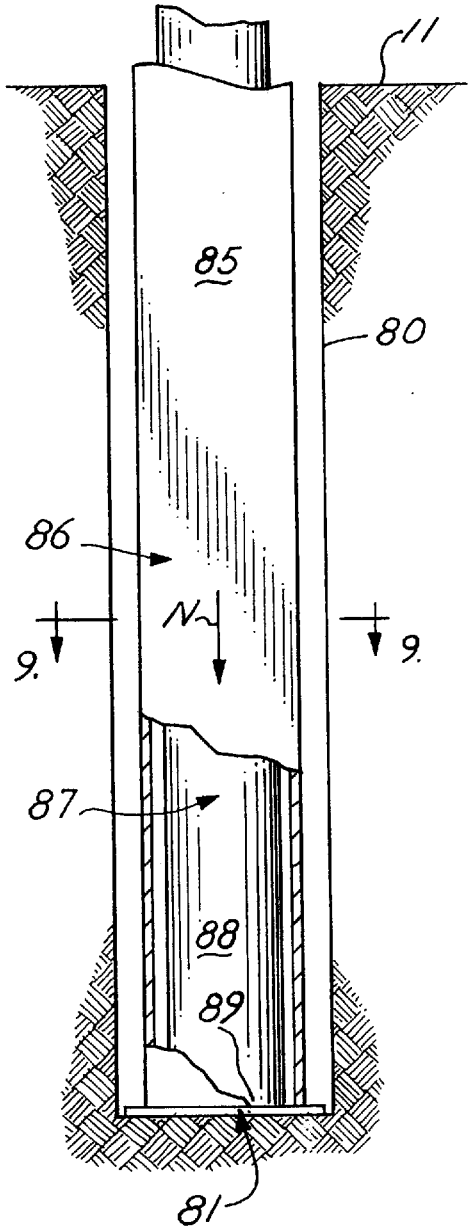
FIG. 6 is an elevation view illustrating another procedure for installing in the ground at a building site apparatus constructed in accordance with the invention.
Figure 9:
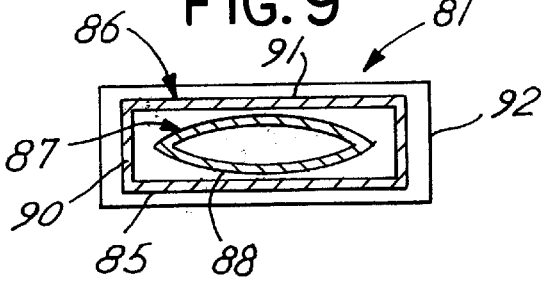

FIGS. 6 and 9 illustrate another method of installing in the ground an expandable member 87 constructed in accordance with the invention. The apparatus utilized in FIG. 6 includes a rectangular steel plate 81, an expandable member 87, and a hollow rectangular mandrel 86. The lower end 89 of member 87 is permanently affixed to plate 81. Elliptically shaped member 87 includes an arcuate front face 88. Mandrel 86 includes rectangularly shaped interconnected sides 88, 90 to 92.

Opening or hole 80 is formed in the ground 11 by using mandrel 86 or other means to drive plate 81 into the ground in the manner illustrated in FIG. 6. While mandrel 86 drives plate 81 into the ground, mandrel 86 extends over and temporarily "houses" member 87 as shown in FIGS. 6 and 9. After plate 81 is driven by mandrel 86 to a selected depth, mandrel 86 is withdrawn from the ground, leaving plate 81 and member 87 in the ground. Member 87 is then inflated or otherwise expanded to compress, stress, and strain soil adjacent opening 80.

Figure 7:
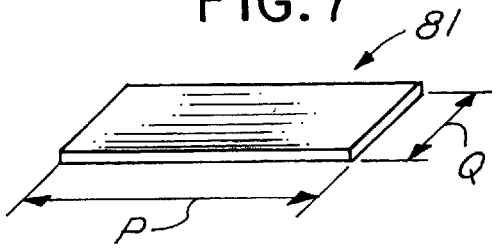
FIG. 7 is a perspective view illustrating a rectangular plate utilized in the procedure illustrated in FIG. 6.
Figure 8:
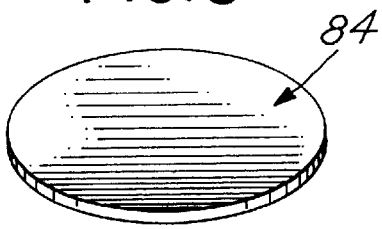
FIG. 8 is a perspective view illustrating another plate which can be utilized in the procedure illustrated in FIG. 6; and, FIG. 9 is a section view taken along section line 9—9 and illustrating further construction details of the procedure of FIG. 6.

The shape and dimension of plate 81 can vary as desired. By way of example, and not limitation, the length P (FIG. 7) of plate 81 is presently in the range of six inches to eighteen inches. The width Q of plate 81 is presently in the range of one to six inches. Plate 81 may take on the oval shape of the plate 84 illustrated in FIG. 8, or can take on any other shape and dimension.

Having described my invention in such terms as to enable those skilled in the art to understand and practice it, and having identified the presently preferred embodiments thereof, I claim:

1. At a site including a section of ground comprising existing soil, the improvement in said site comprising, in combination:

(a) a cavity in the section of ground;

(b) at least one elongate expandable member in said cavity;

(c) a composition in said member, said composition expanding said member to compact soil adjacent said expandable member.

2. A method for building a soil support system including existing soil having an in situ density and an in situ stress state, said method comprising the steps of:

(a) forming a cavity;

(b) providing at least one elongate expandable member;

(c) inserting said expandable member in said cavity;

(d) at last partially filling said expandable member with a composition to expand said expandable member, whereby portions of the soil adjacent said expandable member have increased lateral stress and increased lateral strain.

3. The method of claim 2 including the steps of:

(a) inserting aggregate in said cavity, and;

(b) compacting said aggregate.

4. A method for improving soil at a building site comprising in combination the steps of:

(a) inserting an expandable member into the soil; and (b) expanding the expandable member by inflation thereof.

5. The method of claim 4 wherein said expandable member is comprised of at least one inflatable cell.

6. The method of claim 4 wherein the expandable member is inserted generally vertically downwardly into the soil.

7. The method of claim 4 wherein the expandable member is comprised of a t least two inflatable cells.

8. The method of claim 4 wherein a cavity is formed in the soil and the expandable member is inserted into the cavity prior to expansion.

9. The method of claim 4 including insertion of a plurality of expandable members into the soil.

10. The method of claim 4 wherein the expandable member comprises at least one cell and inflation is effected by pumping material into said cell.

11. The method of claim 4 wherein the expandable member is inflated by at least partially filling the member with a fluid material.

12. The method of claim 4 including the step of forming a cavity in the soil and subsequently placing the expandable member in the cavity.

13. The method of claim 12 including the step of placing at least one compacted lift in the cavity.

14. The method of claim 12 including the step of forming the cavity by inserting a rigid member into the soil.

15. The method of claim 12 including the step of forming the cavity by drilling a hole into the soil.

* * * * *